United States Patent [19]

Whissell

[11] Patent Number: 4,802,836

[45] Date of Patent: Feb. 7, 1989

[54] COMPACTION DEVICE FOR CONCRETE BLOCK MOLDING MACHINE

[76] Inventor: Gilles Whissell, 635 Watson Dr., Lachute (Quebec), Canada, J8H 4H1

[21] Appl. No.: 73,228

[22] Filed: Jul. 13, 1987

[51] Int. Cl.[4] ..... B28B 3/06

[52] U.S. Cl. ..... 425/253; 100/237; 100/269 R; 425/260; 425/351; 425/413; 425/421; 425/422

[58] Field of Search ..... 425/253, 254, 255, 260, 425/344, 346, 351, 357, 358, 413, 419, 421, 422, 424, 432, 452, 456, 448; 100/237, 269 R

[56] References Cited

U.S. PATENT DOCUMENTS

| | | | |
|---|---|---|---|
| 364,948 | 6/1887 | Moore | 100/237 |
| 1,101,986 | 6/1914 | Baute | 425/456 |
| 1,164,726 | 12/1915 | Kramer | 425/456 |
| 1,165,809 | 12/1915 | Solon | 425/456 |
| 1,591,532 | 7/1926 | Ingram | 100/237 |
| 2,341,012 | 2/1944 | Billman et al. | 100/237 |
| 2,381,272 | 8/1945 | Fischer | 100/237 |
| 3,049,988 | 8/1962 | Lindemann et al. | 100/237 |
| 3,181,208 | 5/1965 | Brauer | 425/319 |
| 3,287,766 | 11/1966 | Drabert et al. | 100/237 |
| 3,833,331 | 9/1974 | Springs | 425/253 |
| 3,890,413 | 6/1975 | Peterson | 425/344 |

FOREIGN PATENT DOCUMENTS

| | | | |
|---|---|---|---|
| 677952 | 8/1979 | U.S.S.R. | 100/237 |

*Primary Examiner*—Jay H. Woo
*Assistant Examiner*—James C. Housel
*Attorney, Agent, or Firm*—Robic, Robic & Associates

[57] ABSTRACT

A compaction device for a concrete block molding machine, comprising a mold formed with cells opened at the top and at the bottom, and filled with a no-slump concrete mix. The mold freely rests either on a pallet or vibrating table, which acts as bottom wall for the mold. Compaction shoes, equal in number to the number of cells in the mold, are sized, configured and positioned above the mold so that they may snugly fit into the mold cells. The shoes are mounted at the lower ends of power jacks which are connected to a same fluid pressure source or, alternatively, are altogether in fluid communication. The power jacks are operative to move the compaction shoes over the concrete mix in the cells so as to apply to the mix in each cell, preferably, in the final cycle of vibration, an equal compaction pressure suitably selected to produce concrete blocks having a maximum equal density or more uniform desired or selected physical properties. With the mold held stationary, the support table or pallet may thereafter be moved down away from the mold to allow the concrete blocks to be dislodged from the mold by the downward movement of the compaction shoes. Alternatively, the shoes may be held stationary, above the pallet standing underneath and the mold is moved up, leaving on the pallet a row of dislodged blocks.

8 Claims, 7 Drawing Sheets

COMPACTION DEVICE FOR CONCRETE BLOCK MOLDING MACHINE

BACKGROUND OF THE INVENTION

1. Field of the invention

The present invention relates to an improvement in compaction devices and methods for concrete block molding machines.

The invention is more particularly concerned with the making of concrete blocks requiring better and/or more uniform or selected physical properties, such as compressive strength, durability, flexural strength, permeability, density, color uniformity, etc. and intended for use with regard to any related physical properties including heavy and repeated pounding, as well as under severe weather exposure, such as pavement stones. Other like products contemplated by the invention, are solid or hollow construction blocks or bricks, cubes, cylinders, edging stones, concrete rings or pipes, curb stones, impermeable or permeable elements or any elements made from a no-slump or close to no slump concrete mix, having any particular water/cement ratio, in order to obtain better uniformity and any particularities of the physical properties of concrete. In the present specification, these elements are generically called concrete blocks, for convenience.

2. Description of the prior art

Present day skilled manufacturers use a machine which, broadly speaking, has a feed zone where a hopper pours a no-slump concrete mix of any chosen water/cement ratio into a drawer which is thereafter moved laterally and over the vibrating cells of a mold standing in an adjacent compaction zone. After the cells are filled with the mix, and initially compacted a predetermined lapse of feed time, the drawer is returned to the feed zone, being provided with suitable means to scrape off the tops of the cells, as it moves back to the feed zone. Final compaction, while vibration is going on, is achieved thereafter during a predetermined finishing time, by means of a plurality of fixed compaction shoes, provided at the lower ends of a like number of solid rod or tubing of fixed lengths, of which the upper ends are also fixedly mounted on a vertically movable head plate. For final compaction, the head plate is moved toward the mold, or vise versa, and a given pressure is then applied to the head plate, and hence, to the mix in each cell, by the fixed compaction shoes with or without vibration applied to the head plate and of course transmitted to the compaction shoes, that are solid with the head plate, as aforesaid. After a predetermined period of time of vibration in this last position, finished concrete blocks, are moved out of the mold onto a steel plate or on a steel pallet.

A major difficulty with this type of equipment is that, because the compaction shoes are located at the ends of solid rods or tubings of equal length, and have their flat working surfaces constantly at the same level, that is in the same horizontal plane, final compaction pressure is unequally applied in the various cells, even with vibration on the head. Indeed, the cells are never equally filled and compacted when the drawer backs up, even so, that the top surfaces of the mix in all the cells are at the same level. Thereafter, when comes the final compaction with the compaction shoes, the result is that the concrete mix is fully compacted in some of the cells, and less in others during the period of final vibration and therefore the density in the resulting blocks is not equal.

It follows that, the less dense blocks do not have the expected or required physical properties capable of meeting the stiff specifications of CAN3-A231,2 or A.S.T.M.C936-82 for concrete paving stones, or other concrete blocks for which utmost density, and hence particularities of physical properties, is a most important requirement. In addition of not making full use of the cement powder, these less compacted or dense elements are prone to fail prematurely, or do not have the same properties anticipated. For these reasons, the quality of the finished products is variable and some may have to be rejected. Likewise, other concrete blocks which are less compacted by present day methods, fail to meet their anticipated physical properties and specifications.

Extensive research has demonstrated that all physical properties of a concrete block resulting from a no-slump mix, are very closely related to the density of the compacted mix and this holds true at all water/cement ratios within the no-slump range. This includes the lowest W/C ratio where a minimum of water is necessary to complete the hydration of the cement. But, the same does not apply so significantly to a slump, or near slump, concrete mix where maximum or near maximum density is more easily obtained in each cell due to the hence better workability of the mix, and, where also the physical properties are more uniform but where compressive strength or any other physical properties are often inadequate for different type of concrete blocks or intended to be exposed to severe conditions. It can also be verified that a higher W/C ratio mix may give a higher compressive strength than a lower one due to its better workability and greater density, but such is not the case of its physical properties.

Abram's law which states that the compressive strength of concrete is inversely proportional to the W/C ratio in the mix, applies to a no-slump concrete at any W/C ratio of the no-slump range but it is verified that the Abram's law holds true only if the proper maximum density is reached for all mixes in that ratio range. The compressive strength, flexural strength, durability and permeability are therefore functions of the density at any particular W/C ratio in the no-slump range and any drop of density from the utmost one appreciably reduces the compressive strength and other physical properties. As well, further drop in density causes the undesired water absorption capacity of the concrete to increase and may render the ensuing blocks less weather resistant. Conclusively, the compressive strength and related physical properties are directly proportional to the density at any W/C ratio.

Another interesting fact, noted with lower W/C ratio no-slump concrete, is the linear percentage of the loss of weight of the initial dry mass found between 25 and 50 cycles when the mass is subjected to freezing and thawing, durability tests conducted under CAN3-A231.2M85 specifications for paving stones of ultimate density. There again, the density of the finished concrete blocks is of prime importance and losses in weight in percent of the dry mass increase radically as densities decrease. This is most important and, according to the present invention, a minimum acceptable density can be obtained or found for each mix design and W/C ratio, which will permit a loss of weight of less than 1% under the above specifications and, at the same time, provide durability of all concrete blocks when, as aforesaid, made in accordance with the present invention.

There thus presently exists a problem of uneven properties in all concrete products when made according to the present day methods, due to the fact that these concrete products do not have the appropriate minimum acceptable density for their corresponding W/C ratio mix as above explained, with resulting uneven lower compressive strength, permeability, flexural strength, durability and related properties at least regarding an important number of concrete blocks so made.

In attempting to alleviate the problem of getting full compaction with existing machine, the industry is trying to work at higher W/C ratio to obtain a better density and compressive strength but this is achieved only at great expense in waste of cement and beneficial properties of lower W/C ratio mix. Thus, some devices like heated shoes have been designed. They permit the use of a higher W/C ratio mix and consequently a better workability of the mix but to prevent material from sticking to the shoes, heat has to be used. Of course, a higher workability obtained by adding water does give a higher density but unfortunately, when considering Abram's law, a higher W/C ratio gives lower compressive, flexural and shear strengths, higher water absorption, higher percentage loss of weight, in durability test due to freezing and thawing, and higher shrinkage.

Also, because the mix in some of the mold cells, in present day machines, are still not sufficiently compacted, some other devices, like vibration devices on the head and/or on the foot of the machine, have been used in an attempt to optimize the density. However, the same problem of inacceptable uneven compaction of some of the elements from different cells and consequently too high a disparity in physical properties of end products persist. Some cities using much de-icing salts are now considering not to use certain concrete blocks like paving stones, curbs, etc. in their streets because of their poor durability. The same problem applies to other prefabricated concrete blocks like bricks or pipes where any anticipated physical property such as permeability is not attained because of the uneven density at any W/C ratio mix.

OBJECTS OF THE INVENTION

An object of the present invention consequently lies in providing a compaction device and a compaction method which reduce sufficiently the variation in density between the concrete blocks in the various cells of a mold and thereby likewise avoids the aforementioned difficulties simply, surely and inexpensively.

Another object of the invention is to provide such a compaction device and method which permit a user to establish, for his particular machine and for any particular type of concrete block, after a few tests, proper quality safety factors to meet any required properties and specifications, by property selecting in advance and testing appropriate W/C ratio, aggregate, mix design, type of cement and admixtures to be used. By so doing, the quantity of cement used per unit volume is maintained at its minimum while the specifications or color uniformity, for instance, of all mixes is controlled.

The compaction device and method according to the invention can therefore be used to choose and analyse each of the constituents of a concrete mix by having only one (1) variable at a time; and in the case of Portland Cement for instance physical, as well as chemical properties and coefficient of variation can best be analysed than with the CAN3-A5-M83 specifications. Moreover the same compaction device and method can be used to evaluate each function of a concrete block machine.

SUMMARY OF THE INVENTION

The above mentioned objects are made possible, according to the invention, with a method of compacting no-slump concrete mix of any suitable water/cement ratio in all cells of a mold of honeycomb configuration, which method comprises the step of applying, over the mix in each of the cells, a predetermined equal compaction pressure suitably selected to produce concrete blocks having a maximum equal density and/or maximum equal particular physical properties is all of the cells.

The invention also provides a compaction device for a concrete block molding machine of the type comprising:

a stationary mold of honeycomb configuration having a plurality of cells opened at the top and at the bottom and filled with a no-slump concrete mix of any chosen water/cement ratio;

a pallet o table free of the mold and located beneath the mold to act as a bottom thereof; and means for supporting the pallet or table, said supporting means with the table and/or pallet thereon and said mold being movable vertically toward and away with respect to each other. The compaction device comprises power jack means mounted above the mold, which support plurality of compaction shoes equal in number to the number of the cells, each compaction shoes being sized, configured and positioned above the mold for snug insertion into its correspondence cell. The power jack means are operative to move the compaction shoe over the concrete mix in the cells to apply to the mix, in each cell, a certain, not necessarily constant but equal compaction pressure suitably selected to produce concrete blocks having a maximum equal density in all of the cells.

The power jack means preferably comprise a plurality of fluid operated power jacks equal in number to the number of cells. Each of the power jacks supports one of the compaction shoes and has a fluid cylinder and a piston rod telescopically mounted with the cylinder for linear non-rotatable displacement. All of the power jacks may be connected to means for applying the same fluid pressure to all of the cylinders. Alternatively they may be connected to each other with all of the cylinders in fluid communication to allow transmission of an equal compaction pressure to the concrete mix in each cell through the jack the jack cylinders, rods and compaction shoes.

BRIEF DESCRIPTION OF THE DRAWINGS

A description of a preferred embodiment of the invention now follows having reference to the appended drawings wherein.

DESCRIPTION OF A PREFERRED EMBODIMENT

Figure 1:
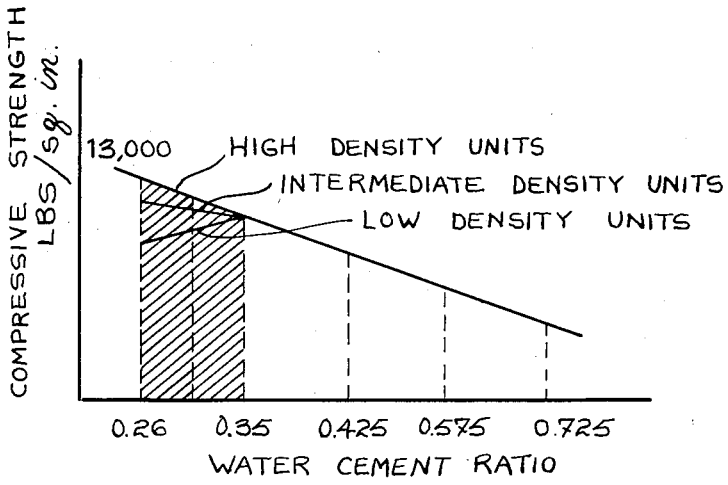
FIG. 1 to 4A are various curves showing pertinent physical properties of concrete blocks obtained with different water-cement ratio or density of no-slump concrete mixes.

FIG. 1 shows a typical section of no-slump mix curves illustrating the relationship between the W/C ratio and the compressive strength for different densities, the linearity of the curve conforming Abram's law that the resistance of concrete is inversely proportional to the W/C ratio but this is true, as indicated above, only if proper density in the mix is achieved. Compressive strength at any W/C ratio is proportional to the density, and a higher W/C mix may have a higher compressive strength than a lower W/C mix due only to its better compaction or density.

For concrete blocks products, such as paving stones, where high compressive strength, flexual strength, permeability and durability are required, the concrete mix has to have a low W/C ratio, and a high density selected in the narrower range of no-slup mixes, lying upmost in the shaded area at the top of the curve. The same relationship applies to higher W/C ratio leaner mixes.

In present day practice, where the compaction shoes are solid with the head plate and all move in unison, equal/or minimal acceptable density of concrete by all compaction shoes is impossible to achieve for the reason mentioned above that some of the compaction shoes rest on top of the more completely filled and compacted cells, while the remaining cells are less compacted with a resulting much lower compressive strength. For that reason, the tendency is to select a higher W/C ratio mix which ensure, because of its better maniability, higher compressive strength than a lower W/C ratio mix not properly compacted; all the blocks that are so produced, may have the minimum resistance required by the C.S/A. or A.S.T.M. specifications, but the W/C ratio is not low enough for acceptable durability test. Actually, the result is that a high percentage of the resulting blocks does not meet these specifications and have to be rejected to avoid premature failing as seen in practice.

Figure 2:
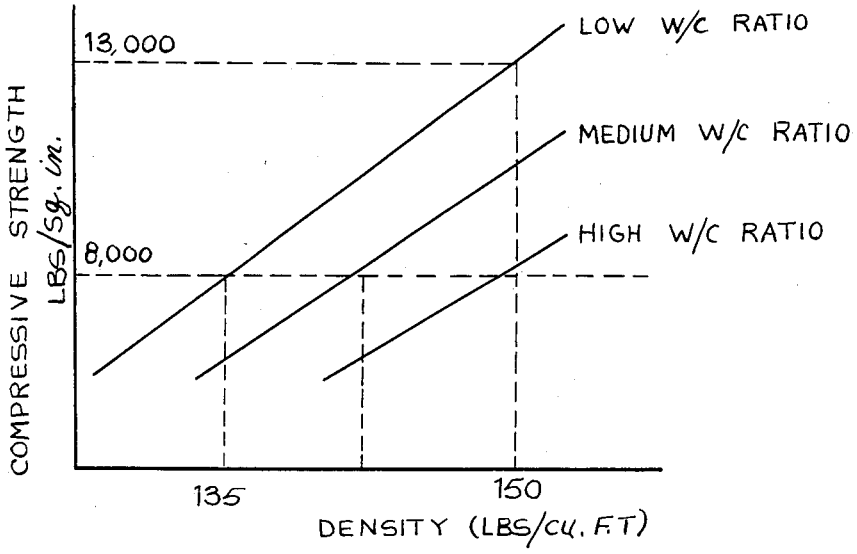

A good result could of course be achieved with power jacks on present day machines, by decreasing somewhat the W/C ratio and by having at least the minimum intermediate density in each unit., as FIG. 1 shows. The , three curves of FIG. 2 clearly show, however, that the lower the W/C ratio is in a mix, the greater is the density range to obtain a given minimum compressive strength. They also show that the specified compressive strength can be obtained by using a mix having different W/C ratio, provided the density in concrete blocks, obtained by greater compaction, is appropriately increased. Again, in known machines, this would be the case only in a limited number of cells, where the respective compaction shoes, solidly rest on the mix and prevent the other cells to further be densified.

Figure 3:
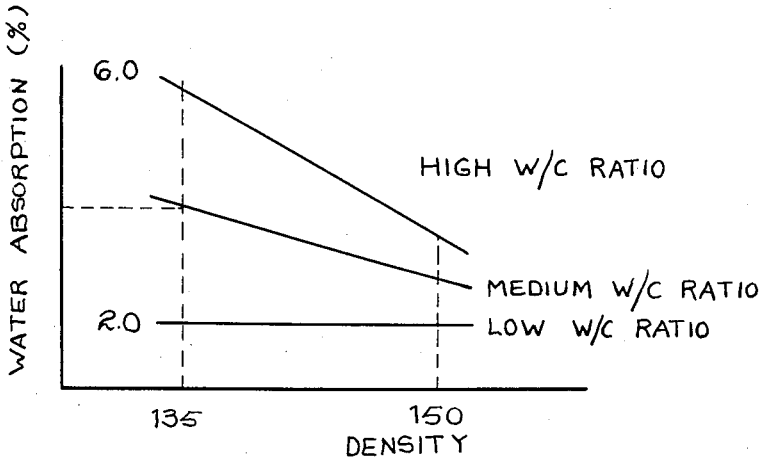

FIG. 3 shows that the lower the W/C ratio is in a mix, the lower is the absorption at any given density. All concrete blocks below the median curve, meet the 5% maximum absorption specification, and such is not the case for the less dense blocks of a slightly higher W/C ratio mix. The water absorption capacity of the concrete can be kept lower if, again, the density is increased.

Figure 4:
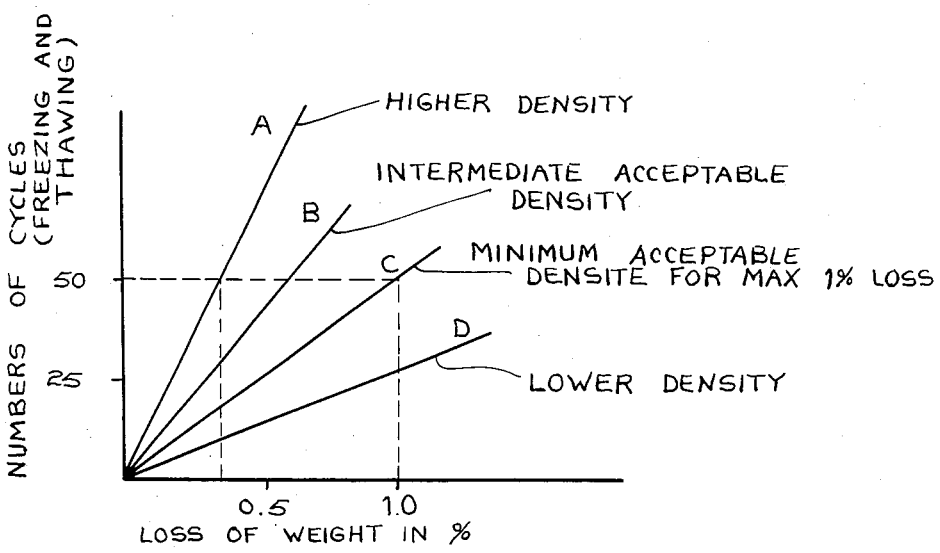

FIG. 4 shows curves resulting from freezing and thawing durability tests, which again illustrate that, at 25 and 50 cycles of freezing and thawing, the percent loss of weight in the concrete at any low W/C ratio increases as the density decreases. Curve A represents the minimum % loss of weight for the denser units. Curves B, C and D represents the % loss of weight as the density decrease. Curve C represents also the minimum acceptable density at a particular W/C ratio, to meet the specification of 1.0% loss of weight. Again, the lower the W/C ratio is in a mix, the lower is the % loss of weight at any given density, and, minimum acceptable density can be found for any W/C ratio. Inversely the maximum W/C ratio can be found for the same % loss of weight.

Figure 4A:
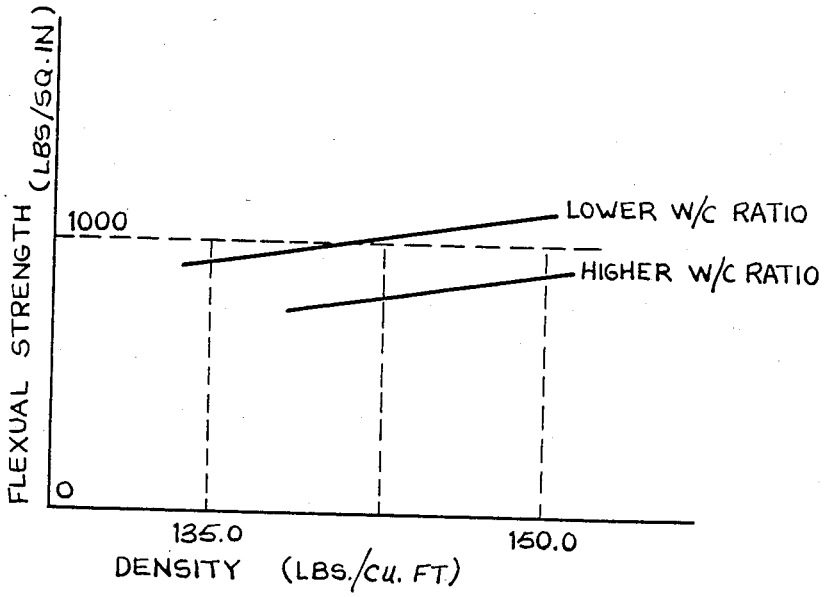

FIG. 4A shows that the flexual strength is directly proportional to the density of the units at any W/C ratio. Here again in present day machines, this can be obtained only if each of the compaction shoes are allowed to best compact more uniformly each cell.

Conclusively and as above indicated, the density is intimately related not only to the compressive strength of the concrete, but to all important physical properties sought in concrete blocks, more importantly if, intended for use to control any particular physicals properties such as required under extreme weather and loading conditions. Thus, when using any concrete mix within the no-slump range, it is possible advantageously depending on properties sought, to use a higher and cheaper more workable W/C ratio within the no-slump range, provided the density is correspondingly increases and uniformly distributed in all the mold cells.

The machine made according to the present invention, schematically shown in Figs, 5, 6 and 7 is able to achieve the above object.

Figure 5:
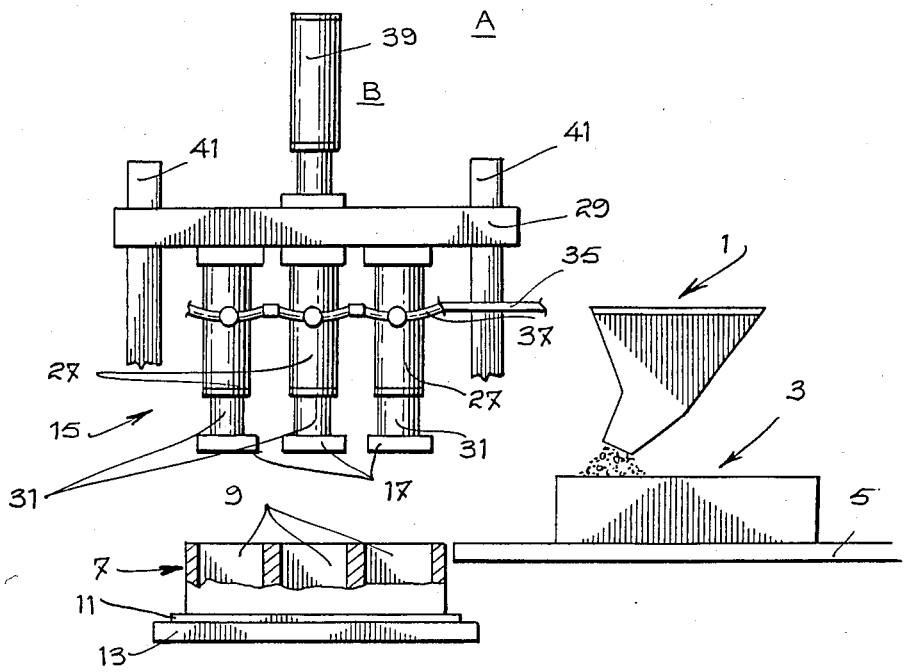
FIG. 5 is a diagrammatic view, in elevation, of a molding machine including the improvement of the invention; the machine being in the mix feeding step.

In FIG. 5, zone A is the feed zone. A no-slump mix of relatively low W/C ratio, 0.30 for instance, is seen being poured by a conventional hopper 1 into a known open top and open bottom drawer 3 resting freely on a table 5 of which the top surface is level with the top face of a mold 7 formed with a plurality of cells 9 and also opened at the top and at the bottom. All cells have the same depth and generally also the same outer configuration, hexagonal for instance, suiting the outer configuration and depth of the final product. The mold 7 rests freely on a metal pallet 11 which, itself, seats freely on rubber supports (not shown). Instead of a metal pallet 11, vibrating table 13 may be used to support the mold 7. The table 13 also seats freely on rubbers. The mold 7 is held stationary by any appropriate means (not shown) but the vibrating table 13 or the pallet 11 are movable vertically between a high and a low position, as shown in FIGS. 5 and 7.

Figure 6:
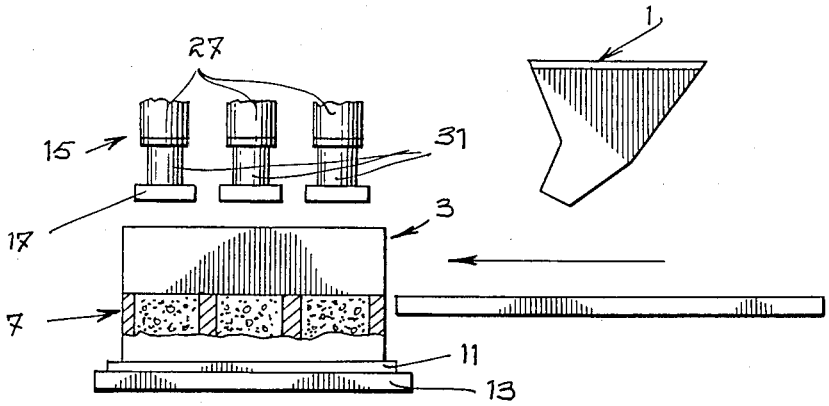
FIGS. 6 and 7 are views similar to that of FIG. 5, showing the no-slump mix being compacted for maximum density.

Once the drawer 3 is filled, it is shifted laterally, in any convenient manner, into a compaction zone B over the mold 7, as shown in FIG. 6, gradually and successively filling and vibrating the mix in each of the cells 9 of the mold 7. The length of initial vibration and feed time is controlled by timers not shown. As is seen, the top of the mix in the various cells 9 actually stands at the same level or horizontal plane, as the drawer goes back to the feed zone. Each cell has then its maximal amount of mix. While such light differences in densities between the cells may be considered negligeable from a practical standpoint of product use, it nevertheless prevents, with known molding machines, attaining in the final vibration period with the fixed shoes, the utmost equal density in the mix of each cell that will give the desired physical properties, as pointed out above.

Figure 7:
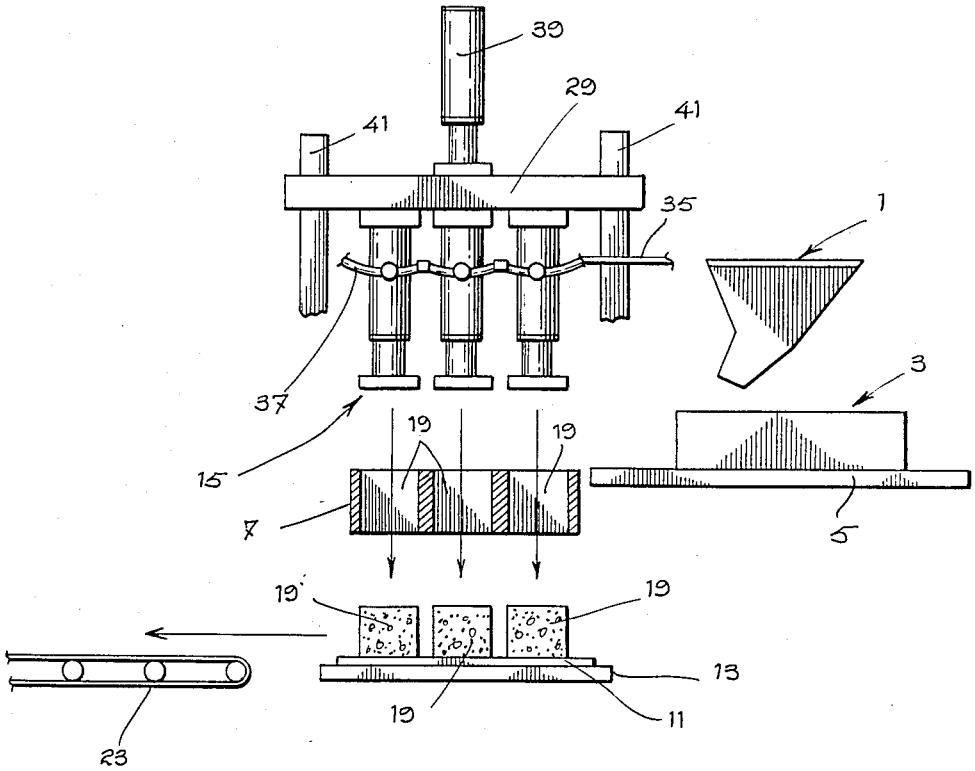

After having filled the cells 9 of the mold 7, while vibration is going on, the drawer 3, may or may not oscillate over the mold 7, and is then returned in the feed zone A over the feed table 5, as shown in FIG. 7. The drawer 3 is equipped with standard scraper means (not shown) for removing, during the return motion, excess concrete mix at the top of the mold 7 and residual mix on the feed table 5.

Above the mold 7, are power jack means 15 having a plurality of compaction shoes 17 equal in number to the number of cells 9. Each shoe 17 is sized and configured for snug insertion, that is with an acceptable tolerance that, for example, may be of about 0.015 inch, into one of the cells 9. The power jack means are made to move the compaction shoes 17 over the concrete mix in the cells 9 to apply, when the steel pallet 11 or the vibrating table 13 and stationary mold 7 are in the high position of FIG. 6 with the drawer 3 moved back into zone A, a constant and equal compaction pressure within the cells 9, during a preselected vibration period of time which is suitably selected to produce concrete blocks having a predetermined maximum density in order to have the desired properties of concrete such as compressive strength, flexual strength, durability and permeability to which reference is made above.

With the mold 7 held stationary and after final compaction of the mix is completed, the foot (not shown) and the steel pallet 11 are moved to the low position of FIG. 7 with the compaction shoes 17 continuing to apply pressure, as shown in dotted lines, to force the concrete blocks 19 out of the cells 9; the pallet 11 with the blocks 19 thereon being then moved, by any convenient means over an adjacent conveyor 23 to be taken away. The foot not shown is then returned to the high position of FIG. 5, beneath the mold 7 and with a new pallet 11 laid thereon, for the start of a new cycle. Alternatively, a vibrating table 13 and a pallet used for curing (not shown) may be used instead of the pallet 11 and the conveyor 23. Feeding and vibrating cycles work on the same principle as pointed out above, except that mold 7 and shoes 17 may be movable in unison with the head plate 29. A steel pallet used for curing is held underneath or a side the machine and the blocks 19 are then moved out of the mold 7, as it is raised vertically while the shoes 17 are held stationary. Blocks may be stacked rows after rows on the pallet (not shown).

Preferably, the power jack means 15 comprise power jacks, each of which has a cylinder 27 made solid at one end with a horizontal head plate 29 slidably mounted on vertical columns 41 of the machine, and a piston rod 31 telescopically mounted :n the companion cylinder 27 for linear non-rotating displacement in view of the vertical anticipated movement of the shoes and the snug fitting of these shoes 17 in the cells 9. The shoes 17 are solidly secured to the lower ends of the rods 31.

The power jacks are in fluid communication with each other, via a manifold 37 connected to all of the cylinders and opening into each of the same. The total pressure applied by all of these jacks to the mix inside the cells is built up by moving down the head plate 29 and the jacks attached to it, preferably with a hydraulic or pneumatic power jack 39 or any other convenient means such as cams or rotary screws extending through appropriate threaded bores in the head plate 29. Of course, the total pressure which is so applied is equal to the sum of the pressure exerted by the weight of the head plate 29 and attached jacks means 15 and the additional controllable and variable pressure exerted by the jack 39 onto the head plate 29.

The power jacks forming the jack means 15 can be operated and/or adjusted independently of the power jack 39 by controlling the amount of fluid fed via the manifold 37 into the cylinder 27, from a pressure fluid source 35. The power jack means 15 may be operated together with the jack 39 to exert an additional pressure onto the mix in the cells. Preferably however, the power jacks of the jack means 15 are merely adjusted so that their rods 31 be initially positioned in the cylinders 27 at half of their working stroke, and then left in fluid communication without further operating the pressure source 35 to allow equalization of the fluid pressure from one cylinder to the others and thus provide application of a constant and equal pressure to all of the rods 31 and therefore to the compaction shoes 17 and mix in the cells when the head plate 29 is moved down by the jack 39.

It is advantageous that the rods 31 and compaction shoes 17 have a working stroke that is only essentially equal to the difference in height that may be permitted to the concrete blocks by the specification. The working stroke must of course be also sufficient to allow achievement of proper density and related physical properties before expulsion of the blocks 19 from the mold 7 at the end of the cycle.

The pressure fluid for the cylinder 27, is preferably hydraulic or pneumatic. The pressure exerted by the cylinder 27 could also be produced mechanically or magnetically, although this may be difficult to reduce into practise at a reasonable cost.

As aforesaid, the movement of head plate 29 is obtained with a hydraulic or pneumatic power jack 39. Alternatively, it can be obtained with a rotating cam system or any other convenient means such as rotary screws. It can further be obtained by mere gravity if the weight of the head plate 29 and jack means 15 is sufficient. The jack 39 serves to move the jack means 15 and head bodily toward the mold 7 before application of a final properly chosen compaction pressure on the cells 9 of the mold 7 in the final stage of vibration with power jack 39. The jack 39 also serves to strip the concrete blocks out of the mold as pointed out before.

Of course, modifications may be made to the structure of the above described machine. By way of example, the compaction shoes 17 could be integrated to the power jack means 15 to form a unitary pressure-operated shoe structure. Alternatively, the cells 9 of the mold 7 disclosed hereinabove as being preferably identical, may be of different height, shape and/or size, being understood that the power jacks will then be sized in length or diameter to accommodate these differences and thus continue to allow application of an equal pressure on the mix in each cell.

Figure 8:
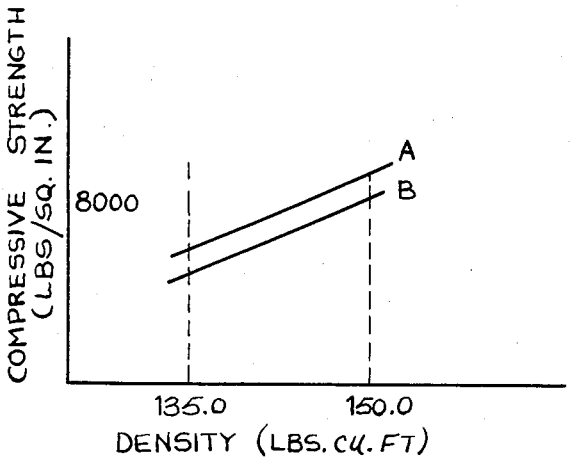
FIG. 8 is a curve similar to FIG. 2, giving the compression strength of a concrete block versus its density and showing the way this information can be used for evaluating the respective properties and quality of similar blocks, of each constituant of a mix or of the functions of a concrete block molding machine or related machines.
Figure 9:
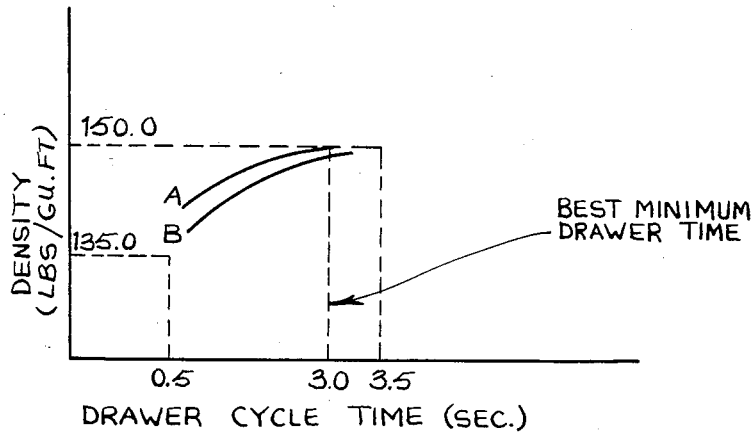
FIGS. 9 and 10 are curves showing how a proper knowledge of the density or compressive strength of the blocks being molded may be used to improve the block molding functions of the molding machine being used.
Figure 10:
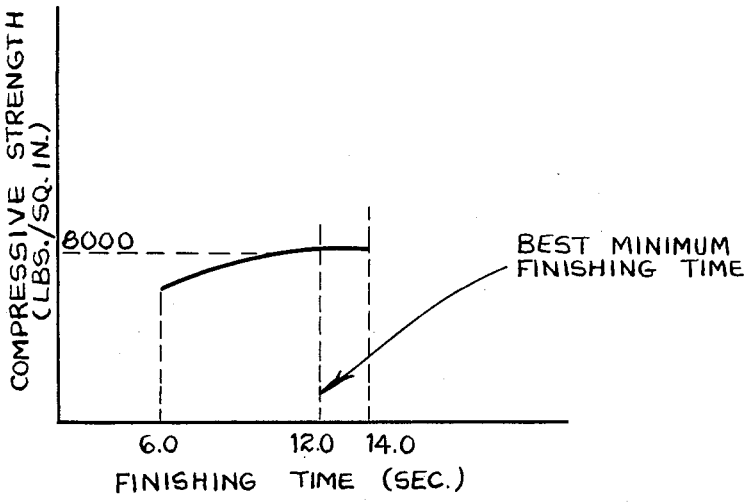

FIGS. 8 to 10 show a very interesting application of the compaction device and method according to the invention for choosing and analysing any of the constituents or additives required in a concrete mix, or for evaluating and properly selecting the best mode of operation of a given block molding machine and related apparatus and machine.

It is well known by any one skilled in the molding art that the substitution of one constituent or additive for another (or the addition of a new one) in a concrete mix may substantially affect the quality of the resulting blocks. Up to now, it has always been very difficult to determine whether a given additive had some positive or negative influence as compared to nothing or to another similar additive, because the quality of the resulting product depends on its density and the latter could never be ascertained without equal compaction in each cell of the mold. The same difficulty is also encountered to compare constituents.

With the compaction device and method according to the invention, the density of all of the blocks being molded is quite identical. Thus any of these blocks may be used and compared with another block of the same density, whatever be this density, thereby making it possible to evaluate the influence of one additive A and compare it with another additive B (see FIG. 8) or to evaluate and compare constituents.

Similarly, proper establishment and ascertainment of the density of all of the blocks being molded by a machine provided with a compaction device according to the invention permits to obtain curves as shown in FIG. 9 and 10, giving the density of the blocks being molded as a function of the drawer cycle time, i.e. the time of the drawer is shifted over the vibrating mold to fill the cells up, and moved back into the feed zone A (FIG. 9) and the compression strength of the blocks being molded as a function of the finishing time, i.e. the time pressure is exerted by the compaction shoes onto the mix in the cells while the mold is vibrated (FIG. 10). These curves make it clear that there exist an optimal drawer cycle time and an optimal finishing time to achieve maximum density and thereby maximum compression strength. When this information is known, one may of course adjust the operation of his machine to achieve the best possible result.

Similar curves may be used to optimize other functions of the machine, like the speed of downward head movement, or of any related machines, like the mixing time.

I claim:

1. In a concrete block molding machine of the type comprising:

a stationary mold formed with a plurality of vertical cells, each of said cells having an open top and an open bottom;

closure means located beneath the mold to close the bottoms of the cells of said mold;

means for moving said closure means vertically towards and away from the mold;

means for filling the cells of the mold with a non-slump concrete mix when the closure means has been moved toward the mold and is closing the bottoms of the cells of said mold;

compaction means for applying a compaction pressure onto the mix poured in the cells, said compaction means comprising:

head plate located above the mold;

a plurality of compaction shoes connected to said head plate, said compaction shoes being equal in number to the number of cells in the mold and each sized, configured and positioned above the mold for snug insertion into one of the cells of said mold, and means for moving said head plate and compaction shoes bodily towards the mold to apply a predetermined compaction pressure over the mix in the cells; and vibrating means for vibrating the mold while a compaction pressure is applied onto the mix in the cells; the improvement wherein said molding machine further comprises:

a plurality of fluid power jacks equal in number to the number of compaction shoes, each of said power jack supporting one of said shoes and comprising a cylinder and a piston rod telescopically mounted within the cylinder for linear, non-rotatable displacement therein, said displacement being such that each power jack has a working stroke essentially equal to a predetermined allowable difference in height of the concrete block to be molded in the corresponding cell; and means for interconnecting the power jacks so that the cylinders of all of said power jacks are in fluid communication with each other;

whereby an equal compaction pressure is applied by each compaction shoe in each cell when the compaction means are operated, thereby allowing production of concrete blocks having the same maximum density in all of said cells.

2. An improved molding machine as claimed in claim 1, further comprising means connected to the power jacks for simultaneously applying the same fluid pressure in the cylinders of said jacks so as to transmit to the concrete mix in each cell an equal compaction pressure through said cylinders, rods and compaction shoes.

3. An improved molding machine as claimed in claim 1, wherein said power jacks are hydraulic power jacks.

4. An improved molding machine as claimed in claim I, wherein the closure means consists of a pallet mounted on a support and the molding machine further comprises conveyor having a top surface alignable with the support of the pallet when said support is away from the mold, for allowing translation of the pallet, and concrete blocks thereon, onto said conveyor.

5. An improved molding machine as claimed in claim 1 wherein the closure means forms part of a vibrating table acting as said vibrating means.

6. An improved molding machine as claimed in claim 1, wherein each compaction shoe is integral with its corresponding power jack.

7. An improved molding machine as claimed in claim 1, wherein the cells of the mold have different heights and the power jacks are sized to accommodate this difference in height to apply an equal pressure in each cell.

8. An improved molding machine as claimed in claim 1, wherein the cells in the mold have different shapes and sizes and the power jacks are sized to accommodate this difference in shape and size to apply an equal pressure in each cell.

* * * * *